US007301507B2

(12) United States Patent
Petersson

(10) Patent No.: US 7,301,507 B2
(45) Date of Patent: Nov. 27, 2007

(54) REFLECTOR COMPRISING A CORE HAVING A THICKNESS THAT VARIES IN ACCORDANCE WITH A GIVEN PATTERN

(75) Inventor: Mikael Petersson, Göteborg (SE)

(73) Assignee: SAAB AB, Linkoping (SE)

( * ) Notice: Subject to any disclaimer, the term of this patent is extended or adjusted under 35 U.S.C. 154(b) by 19 days.

(21) Appl. No.: 11/103,552

(22) Filed: Apr. 12, 2005

(65) Prior Publication Data

US 2005/0243016 A1 Nov. 3, 2005

(30) Foreign Application Priority Data

Apr. 22, 2004 (EP) ..... 04009512

(51) Int. Cl.
*H01Q 15/14* (2006.01)

(52) U.S. Cl. ..... 343/912

(58) Field of Classification Search ..... 343/912, 343/840, 909, 916, 915
See application file for complete search history.

(56) References Cited

U.S. PATENT DOCUMENTS

| | | | | |
|---|---|---|---|---|
| 2,747,180 | A | 5/1956 | Brucker | 342/5 |
| 3,136,974 | A | 6/1964 | Dunkle et al. | 156/74 |
| 3,713,959 | A | 1/1973 | Rottmayer et al. | 291/46.11 |
| 4,578,303 | A | 3/1986 | Kundinger et al. | 428/116 |
| 4,862,188 | A | 8/1989 | Monvoisin et al. | 343/840 |
| 5,184,145 | A * | 2/1993 | Devillers et al. | 343/840 |
| 5,543,809 | A * | 8/1996 | Profera, Jr. | 343/753 |
| 6,064,352 | A * | 5/2000 | Silverman et al. | 343/912 |
| 6,198,457 | B1 | 3/2001 | Walker et al. | 343/840 |
| 6,426,727 | B2 * | 7/2002 | Gilbert | 343/755 |
| 6,744,411 | B1 * | 6/2004 | Osterhues et al. | 343/754 |

FOREIGN PATENT DOCUMENTS

| | | |
|---|---|---|
| EP | 0 948 085 A2 | 10/1999 |
| FR | 86 318 | 1/1966 |

* cited by examiner

*Primary Examiner*—Huedung Mancuso
(74) *Attorney, Agent, or Firm*—Bingham McCutchen LLP

(57) ABSTRACT

The present invention relates to a reflector for a reflector antenna. The reflector includes a reflective surface in the form of a first skin, wherein the first skin is adherent to a core that is substantially thicker than the first skin. A portion of the core not adherent to the first skin is adherent to a second skin in such a way that the core is enclosed by the first and second skin; thus forming a sandwich construction. The core of the reflector has a thickness that varies in accordance with a given pattern so that a stiffening structure is formed in the reflector.

The present invention also relates to a method of forming such a reflector.

20 Claims, 3 Drawing Sheets

REFLECTOR COMPRISING A CORE HAVING A THICKNESS THAT VARIES IN ACCORDANCE WITH A GIVEN PATTERN

FIELD OF THE INVENTION

The present invention relates to the field of electromagnetic wave reflectors and manufacturing methods for such reflectors.

BACKGROUND OF THE INVENTION

Electromagnetic wave reflectors are used in the design of antennas in the telecommunication field. The antennas are in particular used in space applications to equip telecommunications satellites. An antenna with a conventional configuration is composed of a radio frequency source and a reflector with a parabolic form whose concave reflector surface constitutes the active surface. A source is placed at the focal point of the reflector and is designed to emit or receive electromagnetic radiation focalized by the reflector. The reflector can also have other shapes than parabolic, e.g. convex or numerically determined.

There is a strong demand for large size reflectors. These types of reflectors enable communication over greater distances and the reception of weaker signals relative to the noise level, or to transmit with a greater gain signals from high power sources. The gain of a reflector is directly related to its area subtended by the reflector in a plane perpendicular to the axis of the reflector. However, in any type of space application there is always a need for weight optimization. It is therefore essential to find a reflector which may be made light-weight without losing the required electromagnetic properties.

One known design of a thin, light-weight reflector consists of a reflector dish of fiber reinforced plastic material supported by a backing structure or support structure. The support structure has the function of supporting the reflector dish and also of contributing to the rigidity of the reflector structure. U.S. Pat. No. 4,862,188 describes such a reflector having a shaping structure and a reflecting mirror placed against the structure, where the supporting structure is a lattice arrangement. This type of reflector dish allows for a light-weight construction of an antenna with good thermoelastic behavior.

U.S. Pat. No. 2,747,180 discloses a reflector with a honeycomb core. The reflector construction gives a light weight and rigid reflector that does not require a separate support structure. The reflector is a sandwich construction which may be manufactured by performing multiple operations in a mould tool.

However in spatial applications, the antennas need to be as light as possible so as to facilitate the placing in orbit of a satellite equipped with antennas with reflector dishes. It would therefore be beneficial to further reduce the weight of the reflector, while ensuring the required stiffness of the reflector dish.

SUMMARY OF THE INVENTION

In view of the above, it is an object of the present invention to provide a new electromagnetic wave reflector and a method of manufacturing such a reflector.

This object is achieved by a reflector including a reflective surface in the form of a first skin which is adherent to a core that is substantially thicker than the first skin. A second skin is adherent to a portion of the core not adherent to the first skin so that the core is enclosed by the first and second skin; thus forming a sandwich panel. The core has a thickness that varies in accordance with a given pattern so that a stiffening structure is formed in the reflector.

Preferably the core may be substantially made as a honeycomb structure of fiber reinforced plastic or aluminum. It is also possible to include a combination of an aluminum honeycomb and a fiber reinforced plastic honeycomb in the core of the reflector. The core may also consist of foam, ceramic or polymeric material.

Regardless of the choice of material for the core of the reflector, the pattern forming the stiffening structure includes a plurality of protruding ribs extending in at least two directions across the core and/or at least one circumferential protrusion. These protrusions are arranged in the non-reflecting back-portion of the reflector.

In a preferred embodiment of the invention, the first reflector skin includes a lay-up of at least three layers of fiber reinforced plastic. The layers are arranged so that the fibers in each layer are directed in a direction that differs from that of the fibers in the previous layer to ensure good reflecting qualities in the antenna as well as good structural and thermoelastic behavior. The first reflector skin can also be made of at least one fabric layer of fiber reinforced plastic, containing fibers in three directions, or by at least two fabric layers of fiber reinforced plastic, each containing fibers in two directions.

In yet another embodiment of the invention, the second skin includes at least a symmetrical lay-up, as described for the first skin. In order to increase the rigidity in the reflector, the first skin and the second skin, may also comprise additional layers of fiber reinforced plastic as local reinforcement in areas that correspond to the pattern of the stiffening structure in the core.

In a second aspect of the invention, there is provided a method of manufacturing a reflector. A first skin is arranged on a mould tool. A core is adhesively bonded to the first skin. The assembly is cured. The inventive method includes the further steps of machining the core to form a stiffening structure in the core for the reflector antenna. The machining is performed while the assembly is still arranged on the mould tool. After a given pattern for the stiffening structure has been machined in the core, a second skin is bonded to the machined core. The assembly is cured prior to removal from the mould tool.

The manufacturing method enables a substantial reduction in the production time for a reflector. The manufacturing may also be performed more accurately when the reflector is manufactured in a one mould operation.

Additional features and advantages of the invention will appear more clearly from the following detailed description of a preferred embodiment of the invention, which is given by way of non-limiting example only and with reference to the accompanying drawings.

*b*) discloses the back structure of a reflector

Figure 4:
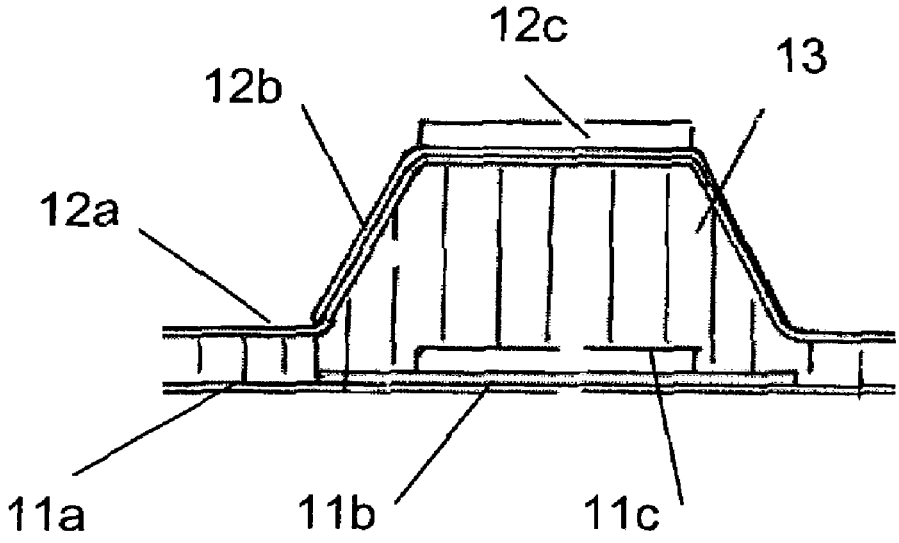

FIG. 4 is a cross-sectional view of section A-A, for the reflector

DETAILED DESCRIPTION OF PREFERRED EMBODIMENTS OF THE INVENTION

Figure 1:
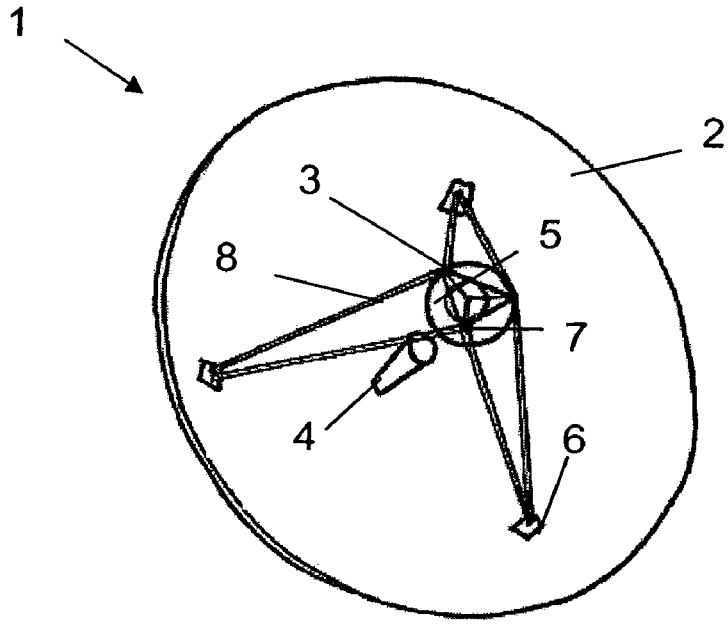
FIG. 1 is a view of a reflector antenna

FIG. 1 depicts a reflector antenna 1 with a reflector 2, a sub reflector 3, feed horns 4, 5, hold down brackets 6, top brackets 7 and struts 8. The feed horns are located at the focus of the antenna or may be offset to one side of the focus.

Figure 2:
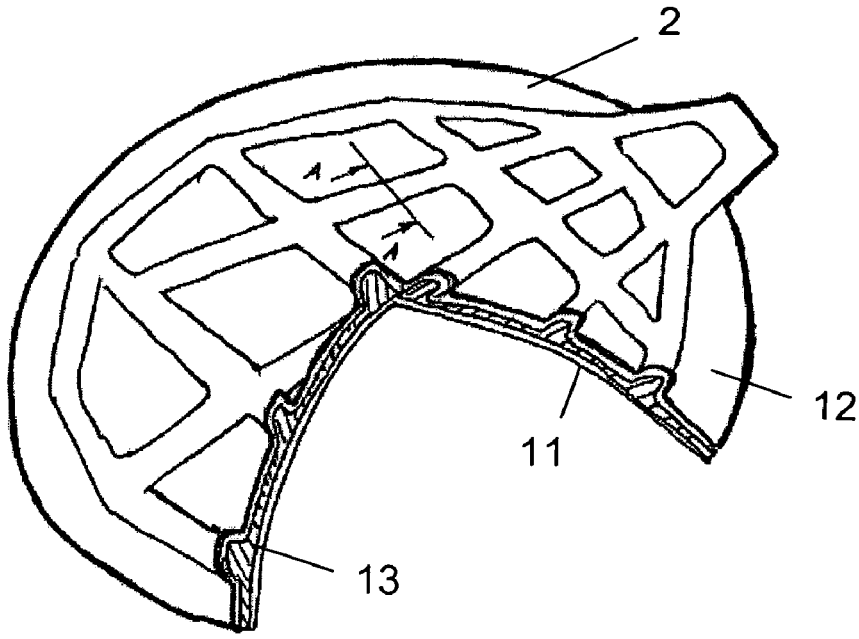
FIG. 2 is a perspective view of a reflector

The reflector 2 is disclosed in more detail in FIG. 2. The reflector is made as a sandwich construction with a first skin 11 and a second skin 12 surrounding a core 13. The core 13 may preferably be a honeycomb core of fiber reinforced plastic or an aluminum honeycomb core.

Figure 3A:
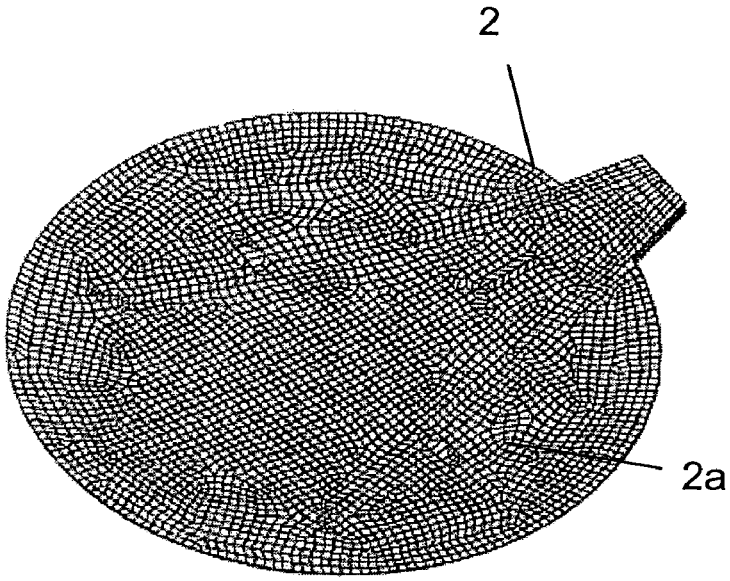
FIG. 3 *a*) discloses the reflective side of a reflector
Figure 3B:
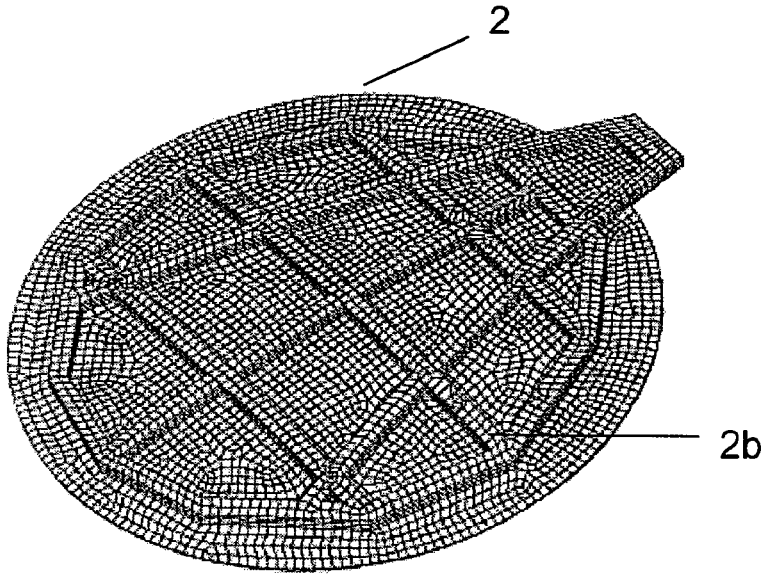

FIG. 3*a* and discloses the reflective first surface 2*a* of the reflector 2. FIG. 3*b* discloses one embodiment of a back structure for a reflector, where the back structure includes a stiffening structure 2*b*. The disclosed stiffening structure 2*b* is one example of many possible structures. The stiffening structure 2*b* for the reflector is machined in the core 13. In FIG. 3*b*, the stiffening structure 2*b* is disclosed as a pattern protruding in the back of the reflector 2. The core 13 is machined so that the thickness of the core 13 varies in accordance with the pattern. The stiffening structure 2*b* may be machined in accordance with any type of suitable pattern that would ensure the desired stiffening qualities. The structure disclosed in FIG. 3*b* is one embodiment for a stiffening structure 2*b*. However, this structure may also be formed by interconnected circumferential elements, rectilinear ribs, curved segments or by any such combination.

The core 13 of the sandwich construction that makes up the reflector 2 may be a honeycomb structure. The structure may be achieved by arranging supporting elements in a direction orthogonal to the first and second skin. Such elements may include pipes, rectangular profiles or standing laminates. However, the core 13 may also include metallic or plastic foam, ceramic or polymeric material. The core 13 may also include more than one layer of honeycomb material, where the different layers of honeycomb material may provide different qualities for the core 13. In areas in the vicinity of an interface in the stiffening structure, the sandwich may include local stiffening e.g., in the form of a honeycomb material with higher density or by increasing the thickness of the first and second skin.

The first skin 11 includes fiber reinforced plastic with fibers arranged in at least three directions. The fibers may be arranged as netting in a tissue or by arranging a lay up of multiple laminates with fibers in one or more directions. If one set of fibers is given a direction of 0°, the two other directions would preferably be ±60°. It is also possible to use a configuration with two fabric layers of fiber reinforced plastic, each containing fibers in two directions and arranged in such a way that the skin contains fibers in four directions.

The lay-up of the second skin 12 is a symmetric lay-up to the lay-up of the first skin 11, i.e., the fibers in the second skin 12 are arranged as a reflection of the fibers in the first skin. With fibers arranged in three directions 0°, +60°, −60° in the first skin 11, the direction in the second skin 12 would preferable be −60°, +60°, 0°.

A reinforced reflector 2 may be achieved by including additional layers of fiber reinforced plastic in the areas if the first skin 11 and second skin 12 corresponding to the pattern for the stiffening structure 2*b*.

FIG. 4 discloses a cross-section along section A-A of the stiffening structure 2*b*. The stiffening structure 2*b* includes a rib or protrusion in the core. The pattern of the stiffening structure 2*b* has preferably been formed by machining in the core 13, during assembly of the reflector. The first skin 11 of the reflector 2 making up the reflective surface includes a first, second and third layer 11*a, b, c* of fiber reinforced plastic. The first layer 11*a* of fiber reinforced plastic is preferably a very thin layer of fiber reinforced plastic. The second layer 11*b* of fiber reinforced plastic is applied below the area of the core that is part of the stiffening structure. The thickness of this layer may be twice that of the first layer. The third layer 11*c* also arranged in accordance with the pattern for the stiffening structure, completes the first skin. The electromagnetic reflection is ensured by providing a symmetrical lay-up of three layers 12*a, b, c* in the second skin 12 giving the reflector good thermo-elastic behavior. As disclosed in FIG. 4, the extension of the different layers may differ. However, it is also possible to have layers extending over the entire surface of the first skin 11 and second skin 12.

In order to provide good reflective qualities for the reflector, the second skin 12 should include a fiber arrangement matching that of the first skin 11. In principle, the reflector 2 is manufactured as a single element by machining the core 13 of the reflector 2 and adjusting the thickness of the first and second skin according to a given pattern. The invention eliminates the need for a separate supporting structure for a reflector 2, while keeping the weight of the reflector in the antenna configuration on a low level.

During manufacture of the reflector 2 a first lay-up of fiber reinforced plastic is applied to a mould tool. When including reinforcement layers in the first skin, these layers are placed according to a given pattern for a stiffening structure on the first lay-up of fiber reinforced plastic.

A layer of resin may be applied to the first layer of fiber reinforced plastic before adding additional layers or the honeycomb core. It would also be possible to use prepreg fiber reinforced plastic, in which case the resin is included in the material of the first skin.

The honeycomb core 13 is arranged on the first skin 11. The assembly is cured, e.g. in an autoclave press.

Following the step of curing the assembly, the stiffening structure 2*b* is machined in the honeycomb core 13 while the assembly still rests on the mould tool. It would also be possible to machine the honeycomb core before applying this to the first skin in the mould tool. However, for ease of manufacture, it is preferable to machine the core when it is part of the assembly in the mould tool. The machining of the stiffening structure as a pattern directly in the honeycomb core provides a large freedom for the choice of stiffening structure. The stiffening structure 2*b* may be given the form of a circumferential structure, possibly in combination with rectilinear beams, curved segments etc.

The second skin 12 is applied on the honeycomb core 13 as a symmetric lay-up to that of the first skin 11. The entire assembly is cured in e.g. an autoclave press or an oven, before removing the reflector 2 from the mould tool.

Depending on the intended use of the reflector 2, the outer edges of the reflector will be machined and openings arranged for inserts.

The described embodiments of the invention are by no means exhaustive; instead it is illustrative of the present invention. The person skilled in the art will readily appreciate that modifications may be made without departing from the scope and spirit of the present invention.

The invention claimed is:

1. A reflector comprising:

a reflective surface and a non-reflecting back portion wherein the reflective surface is in the form of a first skin, which is adherent to a core that is substantially thicker than the first skin; and a second skin adherent to a portion of the core not adherent to the first skin;

wherein the core is enclosed by the first and second skin and the core has a thickness that varies in accordance with a given pattern so that a stiffening structure in the form of protrusions arranged in the back portion of the reflector is formed in the reflector.

2. The reflector in accordance with claim 1, wherein the core consists of a first layer with honeycomb structure.

3. The reflector in accordance with claim 2, wherein the honeycomb structure is a fiber reinforced plastic.

4. The reflector in accordance with claim 2, wherein the honeycomb structure is aluminum.

5. The reflector in accordance with claim 1, wherein the core consists of foam, ceramic or polymeric material.

6. The reflector in accordance with claim 3, wherein the core includes at least an additional layer made of a different material than the first layer.

7. The reflector in accordance with claim 1, wherein the pattern forming the stiffening structure includes protruding ribs extending in at least two directions across the core.

8. The reflector in accordance with claim 1, wherein the pattern forming the stiffening structure includes a circumferential protrusion.

9. The reflector in accordance with claim 1, wherein the first skin includes a lay-up of at least three layers of fiber reinforced plastic, wherein the fibers in each layer are arranged in different directions.

10. The reflector in accordance with claim 1, wherein the first skin includes a lay-up of at least one fabric layer of fiber reinforced plastic containing fibers arranged in three directions.

11. The reflector in accordance with claim 3, wherein the first skin includes a lay-up of at least two fabric layers of fiber reinforced plastic, each containing fibers arranged in two directions; and wherein the layers are arranged in such a way that the skin contains fibers in four different directions.

12. The reflector in accordance with claim 10, wherein the second skin includes a lay-up of at least one fabric layer of fiber reinforced plastic containing fibers arranged in three directions.

13. The reflector in accordance with claim 12, wherein the first skin and the second skin include at least one additional layer of fiber reinforced plastic in areas of the skins overlapping the stiffening structure so that the reflector includes local reinforcements in the first skin and second skin in a pattern corresponding to that of the stiffening structure.

14. A method of manufacturing a reflector comprising the steps of:

arranging a first skin on a mould tool;

bonding a core to the first skin to form a preliminary assembly;

curing the preliminary assembly;

machining the core to form a stiffening structure in the form of protrusions arranged in the back portion in the core;

bonding a second skin to the machined core to form a final assembly;

curing the final assembly; and removing the final assembly from the mould tool.

15. The method in accordance with claim 14, wherein a plurality of layers are arranged on the mould tool to form a laminate in the first skin.

16. The method in accordance with claim 15, wherein each layer is rotated relative to the preceding layer.

17. The method in accordance with claim 14, wherein the core is pre-shaped prior to application on the mould tool.

18. The method in accordance with claim 14, wherein the stiffening structure is machined according to a given pattern including a circumferential protrusion.

19. The method in accordance with claim 14, wherein the stiffening structure is machined according to a given pattern including protruding ribs extending in at least two directions across the core.

20. The method in accordance with claim 14, further including the step of machining the periphery of the cured preliminary or final assembly.

* * * * *